United States Patent [19]

Kodis

[11] 3,952,779

[45] Apr. 27, 1976

[54] TENSION CONTROL AND DRIVE APPARATUS FOR A FABRIC LOOM

[75] Inventor: Rudolfs Kodis, Greenville, S.C.

[73] Assignee: Phillips Fibers Corporation, Greenville, S.C.

[22] Filed: Oct. 17, 1974

[21] Appl. No.: 515,548

[52] U.S. Cl. ..... 139/110; 139/24

[51] Int. Cl.[2] ..... D03D 49/10; D03D 48/18

[58] Field of Search ..... 139/110, 97, 99, 24, 139/327, 1 D

[56] References Cited

UNITED STATES PATENTS

| | | | |
|---|---|---|---|
| 2,440,958 | 5/1948 | Kronoff et al. | 139/110 |
| 2,722,241 | 11/1955 | Alix | 139/327 |
| 3,160,177 | 12/1964 | Williams et al. | 139/24 |
| 3,516,449 | 6/1970 | Darwin et al. | 139/24 |

FOREIGN PATENTS OR APPLICATIONS

| | | | |
|---|---|---|---|
| 1,099,725 | 1/1968 | United Kingdom | 139/110 |
| 1,260,610 | 4/1961 | France | 139/97 |
| 371,406 | 9/1963 | Switzerland | 139/110 |

*Primary Examiner*—James Kee Chi

[57] ABSTRACT

A drive arrangement for driving a let-off beam of a fabric weaving loom and maintaining a predetermined tension in the warp threads. The drive arrangement includes an electric motor operably connected to the let-off beam by a speed-reducing apparatus and an electrically operated clutch. A tension-sensitive device is positioned adjacent the warp threads and cooperates with same to sense the tension therein. The tension-sensitive device has a switch operably connected to said clutch wherein at a predetermined tension in the warp threads the switch closes and actuates the clutch to effect selective driving of the let-off beam in a forward direction and thereby control the tension in the warp threads.

3 Claims, 4 Drawing Figures

TENSION CONTROL AND DRIVE APPARATUS FOR A FABRIC LOOM

One of the more recent developments and trends in the textile industry is the production of woven fabrics using texturized yarn because the fabrics produced exhibit a high degree of stretch. It is desirable in weaving such fabrics to accurately control the warp tension on the loom, preferably at a minimum tension, so that the woven fabric will have a maximum of stretch. In the past, warp tension was controlled by various means which did not accurately effect the desired control. One method of tension control was by the use of a lever arm operably connected by linkages to a variable sheave arrangement wherein varying amounts of weight were carried by the lever arm to adjust the ratio of the variable sheaves and thereby control the drive speed of the let-off beam and the tension in the warp threads. Such a system requires constant attention by an operator with the weight requiring adjustment as the beam decreased in diameter. Such a system has not provided accurate control of tension with resulting inconsistent stretch in fabrics woven from texturized yarn and inconsistent weave density in other woven fabrics.

The objects of the present invention are: to provide a drive and tension control arrangement for a fabric loom which overcomes the above-mentioned difficulties; to provide such a fabric loom with an improved tension control apparatus; to provide such a fabric loom with a drive arrangement having a clutch which is selectively actuatable for selective driving of the let-off beam at a predetermined amount of warp tension; to provide such a tension control apparatus with a tension-sensitive device having an electric switch operably connected to a clutch which is electrically actuatable wherein at a predetermined tension the electric switch actuates the clutch; to provide such a fabric loom with a second switch cooperating with a pattern chain which is operable independently of or in combination with the tension-sensing device to selectively actuate the clutch; and to provide such a drive arrangement and tension-sensing device which is well adapted for its intended use, positive in operation and requires a minimum of operator attention.

Other objects and advantages of the present invention will become apparent from the following description taken in connection with the accompanying drawings wherein are set forth by way of illustration and example certain embodiments of this invention.

Figure 1:
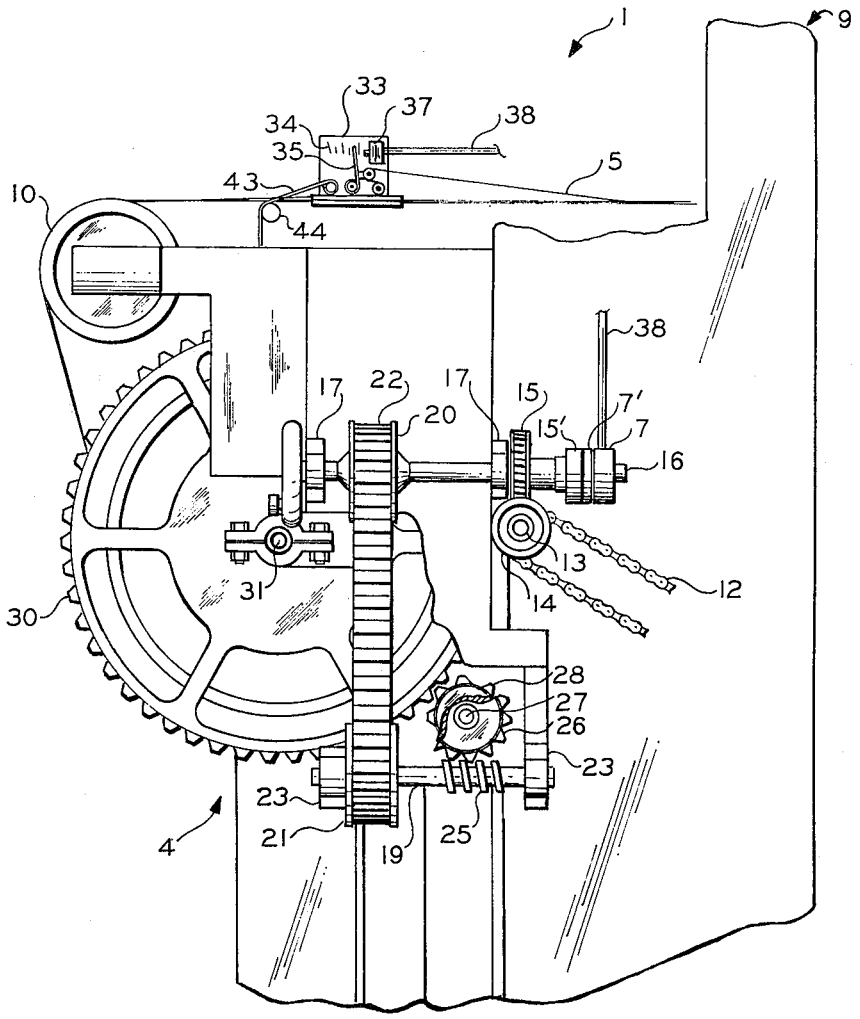
FIG. 1 is a fragmentary side elevation view of a portion of a fabric loom showing a speed-reducing drive arrangement for a let-off beam.
Figure 3:
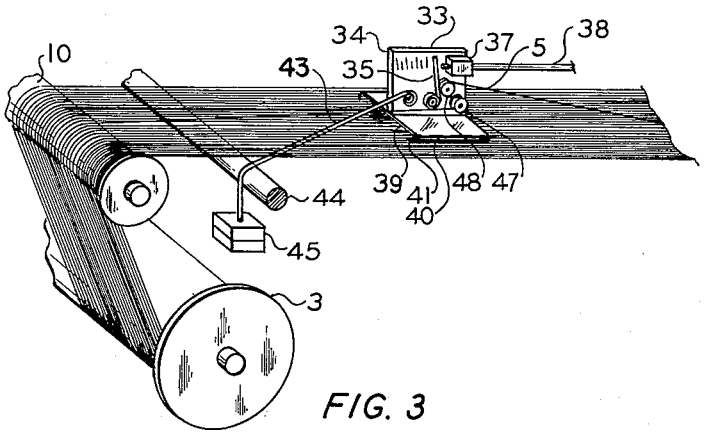
FIG. 3 is an enlarged fragmentary perspective view of a tension-sensitive device cooperating with the warp threads.
Figure 2:
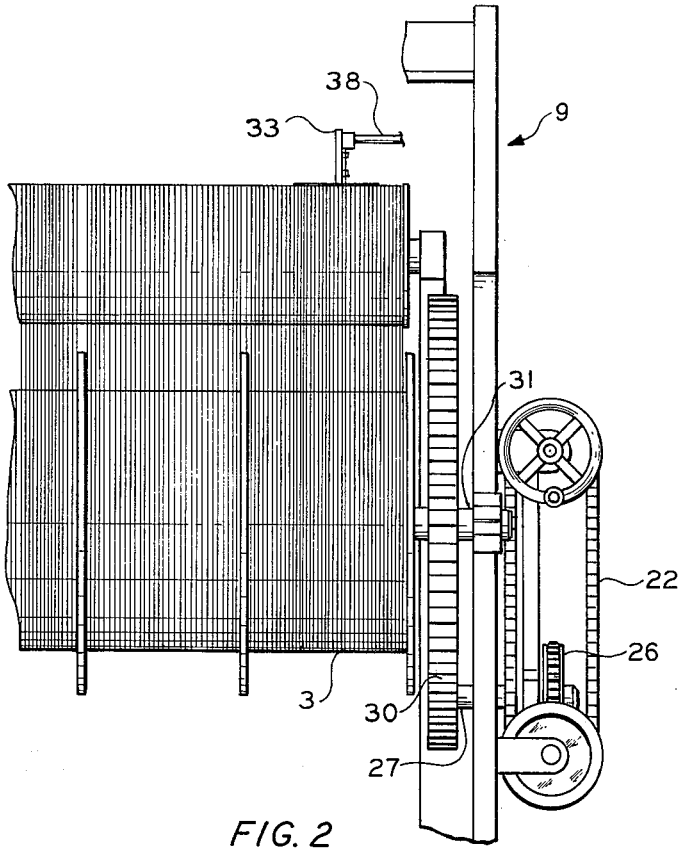
FIG. 2 is a fragmentary front elevation view of a fabric loom showing the drive arrangement and other portions of the fabric loom.

Referring more in detail to the drawings:

As required, detailed embodiments of the present invention are disclosed herein. However, it is to be understood that the disclosed embodiments are merely exemplary of the invention which may be embodied in various forms. Therefore, specific structural and functional details disclosed herein are not to be interpreted as limiting but merely as a basis for the claims and as a representative basis for teaching one skilled in the art to variously employ the present invention in virtually any appropriate detailed structure.

The reference numeral 1 designates generally a fabric weaving loom which is of generally standard construction as is well known in the art. A typical loom of this type is the Crompton Knowles S-6. The loom 1 includes power means (not shown) such as an electric motor which is operably connected to a let-off beam 3 by suitable drive means 4. Control means cooperate with the drive means 4 to control the tension in the warp threads 5 at a predetermined tension which preferably is minimal. The drive means 4 preferably include a clutch 7 which is selectively actuatable by the control means in response to a predetermined tension being reached in the warp threads 5 whereby the let-off beam 3 is selectively driven to maintain a substantially constant tension in the warp threads.

As described above, the fabric loom 1 is of generally standard construction and has a frame structure 9 which supports or carries the various component parts of the fabric loom. The let-off beam 3 is rotatably mounted on the frame structure 9 and a whip roller 10 is also rotatably mounted on the frame structure 9 and positioned preferably above the let-off beam 3. The warp threads 5 are wrapped or wound around the let-off beam 3 and extend upwardly therefrom and partially around the whip roller 10 to other portions of the fabric loom 1.

The drive means 4 in the illustrated structure are operable to drive the let-off beam 3 in a forward direction to permit the warp threads 5 to be unwound therefrom as needed. Any suitable drive means can be provided and, as shown, a chain 12 operably connects the power means (not shown) to a shaft 13 by engagement with a sprocket (not shown) which is secured to the shaft 13. A worm 14 is secured to the shaft 13 and engages a worm gear 15 and attached clutch adaptor 15' both of which are freely rotatable on a shaft 16 unless clutch 7 is activated engaging adaptor 15' to face plate 7' of clutch 7 to drive shaft 16. Shaft 16 is rotatably mounted on the frame structure 9 by bearings 17. In a preferred embodiment of this invention, the clutch 7 is mounted with face plate **7*a* attached to the shaft 16, but it is to be understood that the clutch could be mounted in the drive means 4 at any suitable position between the power means and the let-off beam 3. Preferably the clutch 7 is electrically actuated and is of a conventional type such as a magnetic clutch like the Electroid 90. The worm gear 15 is operably engaged with portions of the clutch 7 wherein actuation of the clutch effects driving engagement between the worm gear 15 and the shaft 16. Drive means operably connect the shaft 16 to a shaft 19 and, as shown, the means include a pulley 20 secured to the shaft 16 and a pulley 21 secured to the shaft 19 with a flexible drive belt 22 engaging both pulleys and effecting driving engagement therebetween. The shaft 19 is rotatably mounted on the frame structure 9 such as with bearings 23 and preferably has a worm 25 secured thereto which is in driving engagement with a worm gear 26. The worm gear 26 is secured to a shaft 27 which is rotatably mounted on the frame structure 9. A gear 28 is secured to the shaft 27 and is in driving engagement with a gear 30 which is secured to a shaft 31 on which the let-off beam 3** is mounted.

In operation, the power means drive the worm 14 and thereby the worm gear 15 and, when the clutch 7 is actuated, the shaft 16 is driven thereby. With the shaft 16 being driven, the belt-and-pulley arrangement drives the shaft 19 which in turn drives the gears 26 and 28 through rotation of the worm 25. Gear 28 is meshed with the gear 30 for driving same and the let-off beam 3. The worm 14 and worm gear 15 arrangement and the worm 25 and worm gear 26 arrangement effect a speed reduction of the output of the power means. When the clutch 7 is deactuated, the shaft 16 is not driven whereby the let-off beam is stationary.

As shown, the warp threads 5 after passing partially around the whip roller 10 travel into other portions of the fabric loom 1 in a substantially horizontal plane. A tension-sensitive device 33 cooperates with at least one of the warp threads 5 to measure the tension therein and control driving of the let-off beam 3 and thereby the tension in the warp threads 5. The device 33 can be of any suitable type, such as a Fatex gauge. The device 33 has indicia 34 thereon and an indicator 35 whereby the tension in the warp threads 35 is preferably continuously monitored. As shown, the device 33 includes a switch 37, such as a microswitch mounted thereon which has an actuating portion thereof selectively engageable with the indicator 35 for selectively opening and closing the switch 37. The switch 37 is connected to a power source (not shown) and the clutch 7 by electrical conductors 35 so as to selectively effect actuation thereof in response to opening and closing of the switch 37. The device 33 can be mounted relative to the warp threads 5 in any suitable manner and, as shown, the device 33 includes a base member 39 which extends generally transversely of the warp threads 5, resting thereon, and having ends 40 which are reverse-bent downwardly forming recesses 41. The base 39, as shown, rests on a plurality of the warp threads 5 with the ends 40 preventing lateral movement of the device 33 by engagement between same and certain of the warp threads 5 which are received within the recesses 41. Means are provided to prevent the device 33 from moving with the warp threads 5. As shown, these means include a flexible member 43 suitably connected to the device 33 and extending therefrom partially around a shaft 44 which is secured to portions of the frame structure 9 and extends transversely of the warp threads 5 just beneath same. Weights 45 are attached to the flexible member 43 and hold the device 33 against movement and in position. As described above, the device 33 cooperates with at least one of the warp threads 5 to measure the tension therein. As shown, a roller or pin 47 is secured to the device 33 and has one of the warp threads 5 extending partially therearound to a second roller or pin 48 which is secured to the indicator 35. The warp thread 5 extends partially around the pin 48 and then back toward the general direction of movement of the remainder of the warp threads 5.

The indicator 35 is preferably spring-loaded against rotational movement, and as tension in the warp threads 5 increases, the indicator 35 pivots and, at a predetermined or preselected amount of tension, the indicator 35 contacts the switch 37 to preferably close same and effect an electrical circuit to the clutch 7. Preferably, the switch 37 is movable on the device 33 so that same is adjustable for the amount of tension necessary to actuate same.

Figure 4:
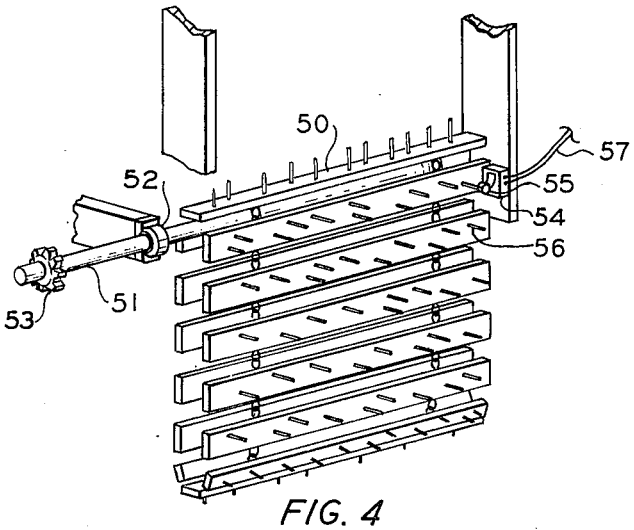
FIG. 4 is an enlarged fragmentary view of the pattern chain of a fabric loom.

As is conventional on fabric looms, a pattern chain 50 is provided and is driven by drive means which, in FIG. 4, include a shaft 51 rotatably mounted by bearings 52 on the frame 9 and having a drive gear 53 secured to the shaft 51. Rotation of shaft 51 through power means (not shown) drives the pattern chain. A second switch 54, such as a microswitch, is preferably mounted on a portion of the frame structure 9 adjacent the pattern chain 50 whereby the actuator 55 of the switch 54 is positioned so as to engage a pin 56 on the pattern chain 50 to effect selective operation of the switch 54. The switch 54 is electrically connected to the clutch 7 and the power source (not shown) by electrical conductors 57. As described below, the switch 54 can be operated independently of or in connection with the switch 37 to effect actuation of the clutch 7.

In operation, when a predetermined tension is reached in the warp threads 5, the switch 37 is closed, thereby actuating the clutch 7 to effect driving engagement between the gear 15 and the shaft 16 to drive the let-off beam 3 in a forward direction to unroll additional length of warp thread and thereby reduce the tension in same a sufficient amount to open the switch 37 to deactuate the clutch 7. With the clutch 7 deactuated, driving of the let-off beam ceases until the predetermined amount of tension is once again reached in the warp threads 5. The switch 54 can also be used to control actuation of the clutch 7 by programming the positioning of the pins 56. The switch 54 can be used in place of the device 33 to control the density of pattern weave. It can also be used to override the switch 37 and permit forward driving of the let-off beam even though the preselected tension for actuation of the switch 37 has not been reached, thereby controlling the weave density.

It is to be understood that while I have illustrated and described certain forms of my invention, it is not to be limited to the specific form or arrangement of parts herein described and shown.

What is claimed is:

1. A tension control apparatus for use on a fabric loom having a let-off beam with a plurality of warp threads wrapped thereon, said apparatus comprising:

a. power means;

b. speed reducing drive means operably connecting said power means to a let-off beam of a loom to selectively drive same, said drive means includes an electrically actuated clutch to selectively effect driving of said let-off beam:

c. a base member adapted to engage a plurality of warp threads and has an upstanding member with indicia thereon, an indicator is movably mounted on said upstanding member and is operable to indicate tension in a thread cooperating therewith;

d. a switch cooperating with said indicator and selectively actuatable thereby, said switch is operably connected to said clutch for actuation thereof, said switch is selectively movable relative to said indicator for adjusting the amount of thread tension required to actuate said switch; and e. means cooperating with said base member to prevent same from moving with said warp threads.

2. The tension control apparatus as set forth in claim 1 including:

a. reverse bent portions on said base member forming thread receiving portions with said reverse bent portions preventing lateral movement of the base member; and wherein b. said switch is movably mounted on said upstanding member.

3. The tension control apparatus as set forth in claim 2 wherein:

a. said means includes a flexible member connected to one of said base member and said upright member and a weight is connected to said flexible member remote from said base member and said upright member with the weight and flexible member associating with a portion of a loom to prevent movement of the base member with the warp threads.

* * * * *